US005433393A

United States Patent [19]

Nishitani

[11] Patent Number: 5,433,393

[45] Date of Patent: Jul. 18, 1995

[54] TRANSFER PRINTING FILM ROLL

[75] Inventor: Nobuhisa Nishitani, Shinjuku, Japan

[73] Assignee: Dai Nippon Insatsu Kabushiki Kaisha, Tokyo, Japan

[21] Appl. No.: 303,202

[22] Filed: Jan. 30, 1989

[30] Foreign Application Priority Data

Jan. 30, 1988 [JP] Japan ..... 63-10522 U

[51] Int. Cl.[6] ..... B65H 75/28

[52] U.S. Cl. ..... 242/160.4; 242/584.1

[58] Field of Search ..... 242/57, 191, 74, 186, 242/160.1, 160.4, 532.4, 584.1; 318/6, 469; 428/40

[56] References Cited

U.S. PATENT DOCUMENTS

| | | | |
|---|---|---|---|
| 3,169,722 | 2/1965 | Bartles et al. | 242/74 |
| 3,248,164 | 4/1966 | Wells | 242/74 |
| 3,321,149 | 5/1967 | Andersen et al. | 242/74 |
| 3,503,568 | 3/1970 | Galley | 242/74 |
| 3,582,013 | 6/1971 | Beretta | 242/191 X |
| 4,135,680 | 1/1979 | Blank et al. | 242/74 |
| 4,181,271 | 1/1980 | Kluczynski et al. | 242/74 |
| 4,275,855 | 6/1981 | Wakabayashi | 242/74 |
| 4,374,883 | 2/1983 | Winslow | 428/40 |
| 4,394,605 | 7/1983 | Terazawa | 318/469 |
| 4,415,615 | 11/1983 | Esmay et al. | 428/40 |
| 4,448,364 | 5/1984 | Frystak et al. | 242/191 X |
| 4,483,492 | 11/1984 | Tokuda et al. | 242/57 |
| 4,506,843 | 3/1985 | Lührig et al. | 242/74 |
| 4,626,256 | 12/1986 | Kawasaki et al. | 428/413 X |
| 4,955,555 | 9/1990 | Pierson et al. | 242/74 |

FOREIGN PATENT DOCUMENTS 5863 of 1985 Japan .

*Primary Examiner*—Daniel P. Stodola

*Attorney, Agent, or Firm*—Foley & Lardner

[57] ABSTRACT

In a transfer printing film roll comprising a bobbin, and a transfer printing film wound around the bobbin, the inner trailing end of the transfer printing film is bonded to the bobbin over the width of the film so strongly as to prevent separation of the film from the bobbin due to the force of a feed motor for paying out the film even when the film has been paid out completely from the bobbin. Because of the strong bonding made over the width of the film, the film can be wound around the bobbin with a uniform distribution of tension and without offset of the side edges of the film wound over each other. When the film has been paid out completely to the trailing end, tension on the film increases so that the load on the feed motor also increases. The increased load can be utilized to detect the end of the film. This eliminates the need of an "END" mark applied to the trailing end of the film for detecting the end of the film.

2 Claims, 1 Drawing Sheet

TRANSFER PRINTING FILM ROLL

BACKGROUND OF THE INVENTION

The present invention relates to an image transfer printing film roll fabricated by winding on a bobbin a length of an image transfer printing film to be used in heat-sensitive image transfer recording. The present invention relates also to a method of detecting an end of the transfer printing film when the same is being paid out from the bobbin.

There have been devised and demonstrated heat-sensitive image transfer recording devices of the type in which an image transfer printing film is supplied from a transfer film roll. In a known transfer printing film roll, the trailing end of a length of the image transfer film is partially and lightly attached via an adhesive tape to a bobbin which is a core of a transfer printing film roll, as disclosed in Japanese Utility Model Laid-Open Publication (KOKAI) No. 5863/1985 published Jan. 16, 1985.

With this known transfer printing film roll, only one portion in the direction of the width of the trailing end of the transfer film is attached to the bobbin so that it is difficult to apply a tension of uniform distribution over the width to the transfer printing film which is being wound around the bobbin, and consequently there arise the problems that the side edges of the transfer printing film wound around the bobbin are not aligned with each other and that the transfer printing film is wrinkled. When a transfer printing film roll is used in a heat-sensitive image transfer recording device, an "END" mark must be applied to the film in the vicinity of the trailing end thereof in order that a sensor mounted in the transfer recording device can detect this mark when the film is going to be unwound completely. It is therefore required to apply such an "END" mark on each transfer printing film before the film is rolled on the bobbin. Further, in this type of transfer printing film rolls, the film is easily separated from the bobbin when the film has been unwound completely from the bobbin, if no provision is made for stopping the unwinding operation, since the adhesion of the film to the bobbin is not strong enough.

The above Utility Model Laid-Open Publication No. 5863/1985 also discloses a transfer printing film roll wherein the trailing end of the film has preliminarily applied thereto an adhesive layer in the shape of a strip extending along the trailing edge of the film, the adhesive layer being covered by a release tape. When the trailing end of the transfer printing film is to be attached to the bobbin, the release tape must be removed and then the film is attached to the bobbin. It is inconvenient and troublesome to remove the release tape before attaching the film to the bobbin, and, moreover, the adhesion of the film to the bobbin is not strong enough again.

SUMMARY OF THE INVENTION

The present invention has for its object to substantially overcome the above and other problems encountered in the known transfer film rolls and provide a transfer printing film roll in which the substantially whole width of the trailing end of the transfer printing film is securely bonded to a bobbin around which the transfer film is wound. The present invention also provides a method of detecting an end of the transfer printing film when the film is being paid out from the bobbin.

BRIEF DESCRIPTION OF THE ACCOMPANYING DRAWING

DETAILED DESCRIPTION OF THE PREFERRED EMBODIMENT

The present invention will now be described in detail with reference to the accompanying drawing.

Figure 1:
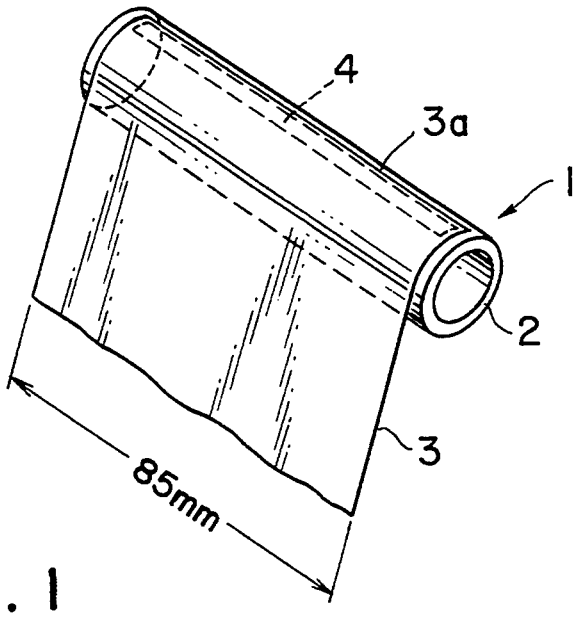
FIG. 1 is a perspective view of a preferred embodiment of a transfer printing film roll in accordance with the present invention, especially illustrating a portion of the transfer printing film in the vicinity of the trailing end thereof.
Figure 2:
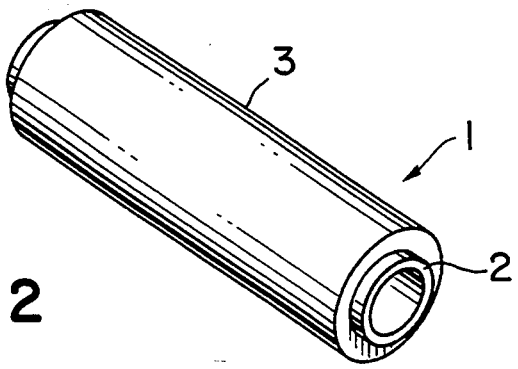
FIG. 2 is a perspective view illustrating the whole construction of the transfer printing film roll.

FIG. 2 is a perspective view illustrating a preferred embodiment of a transfer printing film roll in accordance with the present invention. The transfer printing film roll generally indicated by reference numeral 1 comprises a bobbin 2 which constitutes a core of the transfer printing film roll 1, and a length of a transfer printing film 3 wound around the bobbin 2. The film 3 is, for example, a sublimable image transfer printing film of the type as disclosed in U.S. Pat. No. 4,626,256 to Kawasaki et al. As best shown in FIG. 1, a portion of the transfer printing film 3 in the vicinity of the trailing end 3*a* thereof is securely bonded to the outer cylindrical surface of the bobbin 2 with an adhesive tape 4 having both surfaces coated with an adhesive (to be referred to as "a two-surface adhesive tape" hereinafter) over the whole width thereof. The two-surface adhesive tape 4 used in the present invention has such a high degree of adhesive strength that the trailing end portion of the transfer printing film 3 is securely bonded to the outer cylindrical surface of the bobbin 2. That is, the tensile or adhesive strength of the bond between the transfer film 3 and the bobbin 2 is selected such that the trailing end of the transfer printing film 3 is not permitted to be peeled off the bobbin 2 when the film has been paid out completely through one or more pairs of paying out rollers in a heat-sensitive image transfer recording device. More particularly, the adhesive strength of the tape 4 is from 2 to 5 kilograms per a width of the film of 85 millimeters, and more preferably higher than 3.5 kilograms per a width of the film of 85 millimeters.

Figure 3:
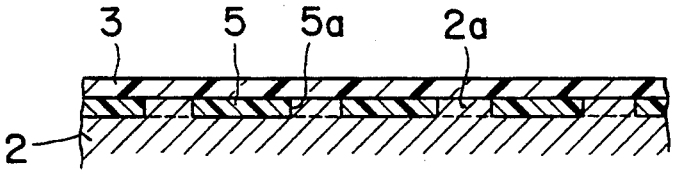
FIG. 3 is a fragmentary section showing a modified example of attaching the transfer printing film to a bobbin.

Instead of directly bonding the trailing end portion of the transfer printing film 3 to the outer cylindrical surface of the bobbin 2, the film 3 may be attached to the bobbin through an intermediary film 5 as shown in FIG. 3. More specifically, the film 5 is a thick perforated film, such as a polyethylene-terephthalate film, for instance, 50 microns in thickness, and is securely bonded to the trailing end of the transfer printing film 3. The outer cylindrical surface of the bobbin 2 has thereon a large number of small protrusions 2*a* over the whole length thereof. Perforations 5*a* of the film 5 are fitted on the protrusions whereby the film 3 is securely attached to the bobbin 2.

As described above, according to the present invention, the trailing end portion of the transfer printing film 3 is strongly bonded to the outer cylindrical surface of the bobbin along the whole width thereof, whereby when the transfer printing film is wound around the bobbin 2, a uniform distribution of tension can be applied to the film 3. As a result, the overlapping side edges of the film are not offset, and both the side faces of the transfer printing film roll made by the rolled film are made flat. Therefore, the transfer printing film unrolled from the roll can be effectively used fully to the portion in the vicinity of the trailing end thereof for the image transfer recording.

The transfer printing film roll 1 thus constructed is set in a transfer recording device, and the transfer printing film is paid out by one or more pairs of feed rollers. Even when the transfer printing film 3 is unwound almost to the trailing end portion thereof, it cannot be stripped off the bobbin 2 because the trailing end portion of the film 3 is strongly bonded to the outer cylindrical surface of the bobbin 2. As a result, the tension exerted on the transfer printing film 3 increases, and the paying off of the film is stopped. More specifically, the increase in tension exerted on the transfer printing film 3 causes increase in the load imparted to a payout motor 6 for driving one or more pairs of feed rollers 7 so that the magnitude of the current flowing through the motor is increased. The increase in the magnitude of the current is detected by a suitable sensor, and in response to the output signal of the sensor the trailing end of the paid out transfer printing film is detected whereby the motor is de-energized. As described above, in response to increase in tension when the transfer printing film is unwound fully to the trailing end portion thereof, increase in load on the motor is caused and detected, whereby the trailing end of the film 3 can be detected without an "END" mark in the vicinity of the trailing end of the transfer film 3.

As described above, in accordance with the present invention, the transfer printing film can be wound around the bobbin without any offset and under uniform tension in an effective manner. As a result, both the side faces of the transfer roll thus formed are made flat. Further, when the transfer printing film roll is used in the heat-sensitive image transfer recording device, the trailing end of the transfer printing film is not stripped off the bobbin even when the film is almost paid out, and the paying out operation can be stopped in response to increase in load on the paying out motor.

What is claimed is:

1. A transfer printing film roll comprising a bobbin, and a length of an image transfer printing film wound around said bobbin; wherein:

a perforated sheet having perforations therein is bonded to a trailing edge portion of said image transfer printing film, said bobbin having a plurality of protrusions fitting into said perforations such that said trailing edge portion resists being peeled off said bobbin when said image transfer printing film is fully paid out and such that top surfaces of the protrusions and a surface of the perforated sheet, facing said trailing edge portion, form a smooth and level surface; and wherein said trailing edge portion directly overlies said perforations and the top surfaces of the protrusions.

2. The transfer printing film roll of claim 1 wherein said trailing edge portion is in contact with the top surfaces of the protrusions.

* * * * *